US006173757B1

(12) United States Patent
Pöhlandt

(10) Patent No.: US 6,173,757 B1
(45) Date of Patent: Jan. 16, 2001

(54) METHOD OF QUALITY CONTROL IN THE PRODUCTION OF FINISHED CAST SHELLS OR CORE STACKINGS

(75) Inventor: Walter L. Pöhlandt, Brühl (DE)

(73) Assignee: Adolf Hottinger KG, Mannheim (DE)

( * ) Notice: Under 35 U.S.C. 154(b), the term of this patent shall be extended for 0 days.

(21) Appl. No.: 09/043,590

(22) PCT Filed: Sep. 23, 1996

(86) PCT No.: PCT/DE96/01803

§ 371 Date: Mar. 20, 1998

§ 102(e) Date: Mar. 20, 1998

(87) PCT Pub. No.: WO97/10910

PCT Pub. Date: Mar. 27, 1997

(30) Foreign Application Priority Data

Sep. 22, 1995 (DE) ..... 195 35 337

(51) Int. Cl.[7] ..... B22C 9/10; B22C 13/12; B22C 19/04

(52) U.S. Cl. ..... 164/456; 164/150.1; 164/151.2

(58) Field of Search ..... 164/456, 4.1, 150.1, 164/151.2, 186, 200, 201, 202

(56) References Cited

U.S. PATENT DOCUMENTS 5,589,650 12/1996 Flemming et al. .
5,711,361 1/1998 Landua et al. .
5,748,322 5/1998 Konder et al. .

FOREIGN PATENT DOCUMENTS 31 48 461 4/1983 (DE) .
94 16 307 U 11/1994 (DE) .
44 34 798 5/1995 (DE) .
195 34 984 8/1996 (DE) .
2-299765 12/1990 (JP) .
2-299766 12/1990 (JP) .

OTHER PUBLICATIONS

*Foundry Trade Journal,* Redhill, "Baxi Foundry automate Disamatic Mould Inspection", vol. 158, No. 3305, May 1985, p. 376.

*Primary Examiner*—J. Reed Batten, Jr.
(74) *Attorney, Agent, or Firm*—Alston & Bird LLP

(57) ABSTRACT

A molding material is forced by a shooting device (3) into an openable tool (4) and solidified therein to a component of a mold (2)—a core or shell. The mold component (2) is removed when the tool (4) is open, and subsequently handled in any desired sequence, transported, and, if need be completed to a core assembly (1). The tools (4) are measured in a noncontacting manner in the region of the shooting device (3) and/or manipulators (5) and/or processing stations (6) and/or storage areas (7) and/or conveying paths (8), that the measured data are supplied to a computer (9), if need be, processed therein, and compared with stored desired values, and that the tools (4) are identified as defective, when a predeterminable or definable deviation from the desired values is detected.

23 Claims, 1 Drawing Sheet

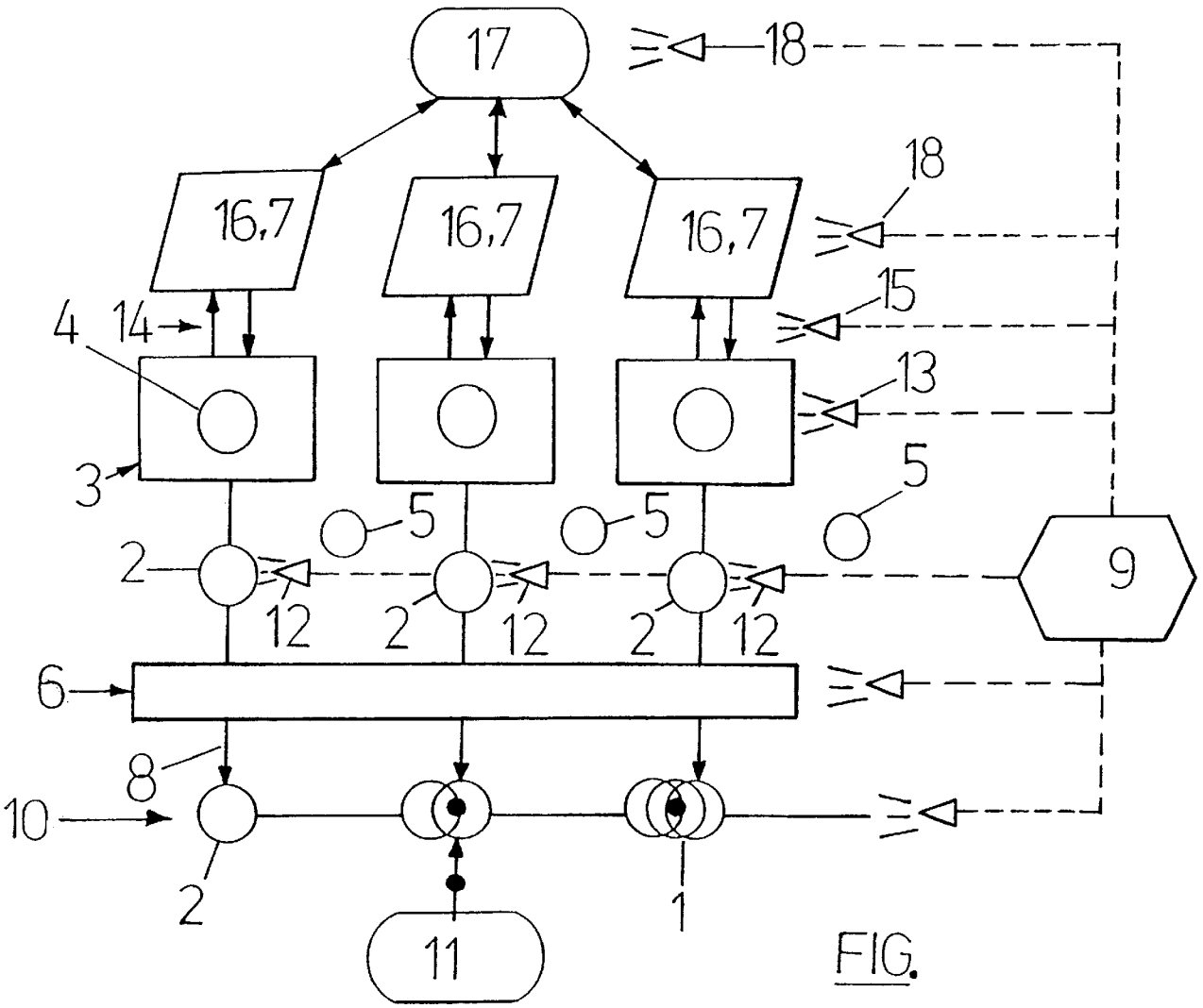
FIG.

METHOD OF QUALITY CONTROL IN THE PRODUCTION OF FINISHED CAST SHELLS OR CORE STACKINGS

BACKGROUND OF THE INVENTION

The invention relates to a method of controlling quality in the production of ready-to-pour shells or core assemblies wherein a molding material is forced by means of a shooting device into an openable tool and solidified therein to form a component of a mold—core or shell—and wherein the mold component is removed when the tool is open, and thereafter handled in any desired order, transported, if need be, processed, and, if need be, completed to a mold assembly.

Basically the present invention relates to the field of foundry practice. To produce castings, foundry cores or foundry molds are generally made as separate parts, combined, and joined together to form a casting mold or core assembly. Thereafter, these core assemblies are filled with molten metal for producing, for example, a metallic workpiece. In mass production the core assemblies that are to be filled with molten metal pass one after the other through the production line.

In this connection, it is quite especially important that the workpieces cast in the core assemblies require an extremely long cooling phase, which will often last over several hours. Only after this cooling phase, is it possible to inspect the cast workpiece or product. Consequently, it is possible to find only several hours after casting and, thus, likewise several hours after the core shooting, whether or not the part cast in the core assembly is entirely free of defects.

In the event that a defective core is used, it will be possible to detect a reject resulting therefrom during the casting only hours after the production of the core. Should in this instance the defect on the core again be a systematic defect that recurs, for example, because of a defect on the tool, rejects will be produced for hours before the defect is found on the cast product. The defective cores that are accountable for these rejects may originate, as previously described, not only from defects in the tool of the core shooting machine, but also from direct damage to the cores during their handling, transportation, or assembly. In any event, it is not justifiable to be able to detect defects and, thus, rejects, only after completion of the casting operation, or during an inspection of the already cooled castings.

Moreover, damage to the mold components and/or tools may occur not only in the immediate vicinity of the shooting device, but also during any handling of the mold component and/or tool, during transportation, during a processing of the mold components, during cleaning of the tools, and in particular also during completion of the mold components to a mold assembly of any configuration.

Core and shell shooting machines of the above-described kind have been known from practice for decades. Only by way of example, reference may be made to DE 31 48 461 C1, which discloses a core and shell shooting machine.

DE 44 34 798 A1 discloses likewise a core and shell shooting machine, in which at least one visual inspection of the tool is provided. In the long run, the visual inspection disclosed in DE 44 34 798 A1 is impractical, inasmuch as the tool cannot be constantly observed, in particular within the scope of a fully automatic production. For a visual inspection, a skilled operator would have to observe the tool constantly, i.e. after each shooting operation. Even if such a visual observation or inspection were to go forward, the destiny of a core that is ejected and intended for further transportation, processing, or completing to an assembly would be left entirely open, since defects or damage may occur likewise during a manipulation or processing of the cores, during a transfer of the cores, or even during an assembly of the cores.

The same applies to the handling of the tools, in particular during a tool change, during cleaning, during transportation of the tools to a storage or during the removal of the tool from the storage or a magazine.

It is therefore the object of the present invention to provide a method of controlling the quality of ready-to-pour shells or core assemblies, which permits detection with a high probability of defects on the tool and, thus, of rejects, and which allows to prevent—systematically—repeating rejects.

SUMMARY OF THE INVENTION

The above and other objects and advantages of the present invention are achieved by a method and apparatus which includes a plurality of core shooting machines disposed along a production line, with each core shooting machine comprising an openable tool. A mold component (i.e., core) is formed at each shooting machine by a shooting device which delivers a molding material into the associated tool, and the resulting mold components are then removed from the tools and assembled to form a core assembly. The mold components and/or tools are measured in a noncontacting manner in the region of the shooting device, and/or manipulators, and/or processing stations, and/or storage areas, and/or conveying paths, that the measured data are supplied to a computer, if need be, processed therein, and compared with stored desired values, and that the mold component and/or the tool are identified as rejects or as defective when a predeterminable or definable deviation from the desired values is found.

In accordance with the invention, one has departed from the conventional production of mold components, in particular shells or core assemblies, wherein a quality control in the course of the core shooting process has been totally nonexistent. Rather, it has been common practice to exchange and clean the tool regularly, or to perform a superficial, visual inspection of the tool in use—once in a while or when need was suspected. In any event, a quality control has until now occurred neither in the actual shooting station, nor in other processing stations, and not even during the handling or transportation of the mold components, though the damage arising from rejects can be considerable in a subsequent casting of workpieces.

In accordance with the invention, it has further been recognized that during the casting process rejects can be effectively avoided, when the produced mold component is not visually inspected—as has been common practice until now—but is measured instead by applying the latest technique. Such a measuring of the produced mold component may occur after opening the tool, and/or during the removal of the mold component, and/or after the removal of the mold component, and it may be noncontacting for purposes of avoiding damage to the mold component. The data obtained from the noncontacting measurement are supplied—on line—to a computer, and—depending on needs—they are prepared or processed therein. These possibly prepared and processed data are again compared with stored desired values of the mold component. If a deviation from desired values is found outside of a predeterminable tolerance range, the measured mold component will be identified as a reject. In this respect, the computer in use for this purpose serves as a process computer, in that it influences the course of the production process to such an extent as to remove—if need be, by manipulators and automatically—the mold component that is identified as a reject. To this extent, it is effectively avoided that a mold component that has been produced or removed from the tool with defects reaches an assembly station or assembly line and constitutes there a cause for a totally defective core assembly.

In an advantageous manner, the desired values of the mold component being monitored with respect to quality and, if need be, also those of the tool, are determined on an "accepted part" with the same device as is used for carrying out the quality control. The thereby-obtained data of the measurement are processed in the computer to desired values and stored in a memory that is provided to this end. In subsequent measurements of mold components, the determined measuring data are compared with the previously stored desired values. Likewise, however, it would also be possible to input the desired values with reference to predetermined technical data, or to compute the surface profile of the mold components or possibly likewise of the tools.

When performing the quality control, each produced mold component could be measured, so as to prevent by all means a transfer of a defective mold component. To reduce the control expenditure, in particular to lessen the computing time, and to avoid a negative influence of the quality control on the cycle time, it would be possible to measure only mold components that are selected via a random generator based on any desired mathematical or statistical models. Likewise, it would be possible to measure every nth produced mold component, with the parameter n being predeterminable or adjustable as desired. Since it is known that tools wear off or must be cleaned after a certain service life, the parameter n could be automatically reduced as the service life of the tool increases, so that almost every or even each mold component is measured shortly before a tool change.

Within the scope of the quality control being performed, it would be possible to measure the mold component and possibly the tool as a whole, i.e., over their entire surface. This measurement will also allow to cover recesses, undercuts, or the like by suitable detectors. By experience, however, defects occur very predominantly in critical areas, so that it is again possible to reduce the time necessary for the detection or measurement, in that the mold component and, if possible, also the tool are measured only in part, namely in particular in predeterminable critical areas. In this respect, it would be possible to reduce the time necessary for the measurement by a purposeful detection.

Besides the previously described noncontacting measurement of the mold components on the one hand and of the tools on the other, it would be possible to have a monitoring precede the actual core shooting process. This monitoring would ensure a proper filling of the shooting heads. To this end, it would be possible to measure, likewise in a noncontacting manner, the device that serves to fill the shooting heads—with and without storage containers for molding materials of any kind—in its position above the shooting head. If the data of such a measurement do not correspond to predetermined desired values, it will be possible to carry out a fully automatic readjustment and, thereafter, a repeated examination of the position.

As previously described, defects on the mold components occur not only during the actual shooting of the mold, during the opening of the tool, or during the removal of the mold components from the tool, but may also occur in the course of further processing of the mold components, up to and including their combining to a mold assembly or a core assembly. Consequently, it is particularly advantageous to perform a more extensive monitoring or measuring of the mold components, in particular when the mold component is handled in any manner during or after its removal from the tool. For example, the mold component may be gripped by a manipulator and brought by same to a transfer or processing station. In this respect it would be possible to measure the mold component, in a noncontacting manner, before, during, or after its delivery to the transfer or processing station, or before, and/or during, and/or after its transportation. To avoid repetitions, the previously described measurement in the region of the core shooting machine is herewith incorporated by reference, inasmuch as also in this instance the same criteria apply, or the same measures are to be taken.

In a further operation, it is possible to combine the produced components with other parts to form an assembly. Such other parts can be made available from a magazine or a storage. In this respect, it will further be of advantage, when the mold component and/or possibly the part being inserted are measured in a noncontacting manner before, and/or during, and or after the insertion or combination, inasmuch as the mold components or possibly the parts being inserted may also be damaged in this process.

Within the scope of a more extensive measure of the entire quality control, it will be quite especially advantageous, when the shooting device is monitored in addition. Normally, the shooting device includes a shooting head mounted on the side facing the tool. In turn, this shooting head is provided with a shooting plate containing shooting nozzles. As previously described with reference to both the mold component and the tool, it would be possible to measure this shooting head in a noncontacting manner. In this instance, very special attention would have to be paid to the shooting nozzles. A noncontacting measurement of the shooting head or the shooting nozzles may occur before the filling of molding materials or after the shooting, i.e., after emptying the shooting head. In the event that the shooting nozzles are found clogged, the shooting head will have to be exchanged and/or cleaned.

Likewise, it is possible that a shooting hood or the shooting head are measured in a noncontacting manner before, and/or during, and/or after cleaning, so as to be able to detect the quality of the cleaning process or the proper condition of the shooting head. Likewise in this respect, defects during the core shooting operation are avoided.

Similarly to the determination of the desired values for the mold component, it is also possible to determine the desired values for inspecting the tool, namely in that these desired values are determined directly on the tool before or after shooting a mold component that is identified as an "accepted part." These values are prepared or processed in the computer and stored in a special memory as desired values. To rate the condition of the tool, each of the determined values is compared with the desired values, thereby facilitating likewise a direct evaluation of the condition of the tool.

In like manner as the mold components, the tool may be measured after removal of each produced mold component. Likewise, it would be possible to measure the tool after removal of every nth produced mold component, with the parameter n being predeterminable as desired. As the service life or the operating time of the tool increases, the parameter n may be automatically decreased, so that shortly before a predetermined tool change, the tool is inspected or measured after almost each produced mold component.

In the case of detecting a defect on a mold component, the quality control could be devised, or the computer could control the detection device, in such a manner that the tool is measured, preferably immediately before, while, or after removing the mold component from the tool. A measurement of the tool before removing the mold component is possible only to a limited extent. In any event, the detection of a defective mold component is to lead to an immediate inspection of the tool.

In like manner as the mold component, the tool may be measured as a whole. Moreover, for purposes of shortening the detection time, it will be advantageous to associate a defect detected on the mold component to the corresponding region on the tool, which is possibly accountable for the defect on the mold component. This region may be examined or measured in a purposeful manner, so as to detect even slightest deviations from desired values.

If a defect is detected on the tool, it will be possible in a further advantageous manner to automatically initiate a tool change. After exchanging the defective tool, it would then be necessary to determine, whether or not the defect resulted from contaminations or wear. In this instance, an evaluation by a specialist—off side the actual production process—will barely be avoidable.

In general, the previously addressed exchange of the tools occurs fully automatically, with the aid of a tool changing device. In the concrete case, the tool being removed and/or the tool being replaced may be measured in a noncontacting manner, before, and/or during, and/or after the exchange, as has previously been referred to. However, in a further advantageous manner it is also possible to proceed with a more extensive monitoring or inspection of the tools, in particular when the tools being removed or replaced can be stored in a parking station or a tool storage and respectively removed from the parking station or the tool storage. In such an instance, the tools may be measured in a noncontacting manner before depositing same in the parking station or tool storage, and/or after depositing same in the parking station or tool storage, and/or after removing same from the parking station or from the tool storage. The same applies to a cleaning station. Thus, it is detected in any event, whether or not the tools are still free of defects after the respective handling.

The noncontacting measurement of both the mold components and the tools may occur with the use of a great variety of techniques. Thus, for example, it is possible to scan in a noncontacting manner the mold components that consist of molding materials by means of a sensor arrangement that operates by capacitance. Depending on the material of the mold components, and in particular also for a noncontacting measurement of the tools, a sensor arrangement operating by inductance or by the eddy current principle presents itself in addition to the capacitive sensor arrangement.

Regardless of the materials of the parts—mold components or tools—that are to be measured, the measurement may also occur by means of a sensor arrangement operating with ultrasound or by means of an optical sensor arrangement. The use of an optical sensor arrangement will require an adequate illumination. Especially advantageous within the scope of an optical sensor arrangement is the use of a video camera with a subsequent optical image processing, wherein the grey and/or color shades of the video images that are taken of the component being monitored are compared with previously stored grey shades and/or color shades of an "accepted component." In this way, it is possible to conduct a comparison of surface structures and, thus, a quality control.

Finally, the mold components may be monitored—possibly in addition to the foregoing monitoring—by determining their weight, namely by a simple weighing operation, preferably on a defined substrate. Likewise, in this instance—possibly in addition—it would be possible to determine in the case of a predetermined compression of the molding materials, whether or not the mold component comprises too much or too little material and may therefore be defective.

There exist various possibilities of improving and further developing the teaching of the present invention. To this end, reference may be made on the one hand to the claims and on the other hand to the following description of an embodiment of the invention with reference to the drawing. In conjunction with the description of the preferred embodiment of the invention with reference to the drawing, also generally preferred embodiments and further developments of the teaching are described.

BRIEF DESCRIPTION OF THE DRAWINGS

The single drawing is a block diagram schematically illustrating the method of the present invention with reference to a core shooting device with three shooting stations and subsequent stations likewise monitored in a noncontacting manner.

DETAILED DESCRIPTION OF THE PREFERRED EMBODIMENTS

Within the scope of a merely arbitrarily selected embodiment, the single drawing illustrates stages of the production of ready-to-pour shells or core assemblies, which can be covered by the quality control. Specifically, reference is made to the production of core assemblies 1 of individual cores 2, wherein a molding material is forced by means of a shooting device 3 into an openable tool 4 and solidified therein to a core 2. The component of a mold or core 2 is removed when the tool 4 is open, and subsequently handled, transported, processed, and finally completed to a core assembly 1.

In accordance with the invention both the mold components or cores 2 and the tools 4 are measured in a noncontacting manner not only in the region of the shooting device 3 as well as in the region of manipulators 5, but also on processing stations 6, in storage areas 7, and in the region of conveying paths 8. The measured data are supplied to a computer 9, processed therein, and compared with stored desired values. When a predeterminable or definable deviation from the desired values is detected, the mold component 2 and the tool 4 are identified as rejects or as defective.

In the embodiment illustrated in the single drawing, the mold component 2 is transported to a, processing station 6, where the mold component 2 may undergo, for example, a deburring. Subsequently, the mold component 2 is linearly transported along a conveying path 8 to an assembly station 10. At this station, the mold components 2 are assembled. In this process, parts are made available from a magazine 11, inserted into one of the mold components 2, and combined together with other mold components 2. At all stations, the mold components are measured in a noncontacting manner, namely by means of a measuring device 12, which is optical in the present embodiment, and comprises a video camera with a subsequent optical image processing.

Furthermore, for the optical measurement of the shooting head, a further measuring device 13 is provided, which is in the selected embodiment an ultrasound device with a corresponding sensor arrangement.

In addition to the monitoring of the cores or mold components 2 as well as the shooting device 3, the tools 4 are monitored in a noncontacting manner, namely in the region of a tool change device 14. Likewise in this region, a measuring device 15 is provided, which includes optical sensors or a video camera. Both the tool 4 being removed and the tool 4 being replaced are measured in a noncontacting manner before each tool change.

Associated to the tool changing station 14 is a parking station 16 or a corresponding tool storage, which is intended for receiving or removing the tools 4. This parking station 16 is again connected to a tool cleaning device 17, which is likewise monitored in a noncontacting manner by a measuring device 18. As a result, it is possible to examine the tool or tools 4 in all stations for their satisfactory condition, or it is possible to detect defective tools 4 regardless of the location of damage. It is then possible to exchange or remove the tool 4—likewise fully automatically.

While within the scope of the above-described embodiment an optically operating sensor arrangement is used, it is also possible to use other measuring devices. Besides a sensor arrangement operating with ultrasound as well as by inductance or by the eddy current principle, it would be possible to use—as an alternative or in addition—a weighing sensor arrangement, which permits examination by weight of the mold components and, if need be, of the tools for their—hypothetical—completeness.

Finally, it should be expressly remarked that the foregoing embodiment serves only for a better understanding of the claimed teaching, without however limiting same to this embodiment.

I claim:

1. A method of controlling the quality of individual cores to be used in the fabrication of multi-part core assemblies which serve as foundry molds, and comprising the steps of providing a plurality of core shooting machines disposed along a production line, with each core shooting machine comprising an openable tool, shooting a core in the tool of each of the core shooting machines, removing each of the cores from their associated tools and assembling the removed cores to form a core assembly, periodically measuring the tools in a non-contacting manner and supplying the measured data to a computer which compares the measured data of each measured tool with stored desired values, and identifying as defective any tool having measured data which deviates from the stored desired values by more than a predetermined amount.

2. The method as defined in claim 1 wherein the stored desired values are determined by an analysis of an acceptable tool.

3. The method as defined in claim 1 wherein the measuring step includes measuring each of the tools.

4. The method as defined in claim 1 wherein the measuring step includes measuring only the tools that are selected by a random generator.

5. The method as defined in claim 1 wherein the measuring step includes measuring each tool upon the nth core being produced thereon, with n being predetermined.

6. The method as defined in claim 5 wherein n is automatically reduced as the service life of the tool increases.

7. The method as defined in claim 1 wherein the measuring step includes measuring each tool as a whole.

8. The method as defined in claim 1 wherein the measuring step includes measuring at least one predetermined critical region of each tool.

9. The method as defined in claim 1 wherein each core shooting machine further comprises a shooting device for shooting a core in the tool of each of the core shooting machines, and the measuring step includes periodically measuring in a non-contacting manner the positioning of each of the shooting devices.

10. The method as defined in claim 1 wherein the removing step includes engaging each core with a manipulator and transporting the engaged core to a transfer or processing station, and wherein the measuring step includes measuring each core in a non-contacting manner before, during, or after its having been transported to the transfer or processing station.

11. The method as defined in claim 1 wherein upon detecting a defect in any tool, exchanging a new tool for the defective tool.

12. The method as defined in claim 1 wherein a magazine or a storage is provided for parts to be assembled with the cores to form a complete core assembly, and wherein the measuring step includes measuring each part in a non-contacting manner.

13. The method as defined in claim 1 wherein each core shooting machine further comprises a shooting device having a plurality of shooting nozzles, and wherein the measuring step includes periodically measuring in a non-contacting manner the shooting nozzles of each shooting device.

14. The method as defined in claim 1 wherein a tool storage is provided for receiving tools prior to replacing a defective tool, and wherein the measuring step includes measuring in a non-contacting manner the tools received in the tool storage.

15. The method as defined in claim 1 wherein the measuring step includes measuring the selected tools utilizing a sensor arrangement which operates by capacitance, or induction, or the eddy current principle.

16. The method as defined in claim 1 wherein the measuring step comprises utilizing ultrasound.

17. The method as defined in claim 1 wherein the measuring step comprises utilizing an optical sensor.

18. The method as defined in claim 1 wherein the measuring step comprises utilizing a video camera with an image processing unit.

19. An apparatus for controlling the quality of individual cores to be used in the fabrication of multi-part core assemblies which serve as foundry molds, and comprising a plurality of core shooting machines disposed along a production line, with each core shooting machine comprising an openable tool and a shooting device for delivering a molding material into the associated tool, a plurality of manipulators for removing each of the cores from their associated core shooting machines and assembling the removed cores to form a core assembly, a detection device for periodically measuring in a non-contacting manner the tool at each core shooting machine and supplying the measured data to a computer which compares the measured data of each measured tool with stored desired values, and whereby any tool having measured data which deviates from the stored desired values by more than a predetermined amount may be replaced.

20. The apparatus as defined in claim 19 wherein a detection device is mounted for movement in the region of each tool and its associated manipulator.

21. The apparatus as defined in claim 19 wherein each detection device comprises a sensor operated by capacitance, or inductance, or the eddy current principle.

22. The apparatus as defined in claim 19 wherein each detection device comprises an optical sensor.

23. The apparatus as defined in claim 19 wherein each detection device comprises a video camera with an image processing unit.

* * * * *